US011802467B2

(12) United States Patent
Procinsky

(10) Patent No.: US 11,802,467 B2
(45) Date of Patent: Oct. 31, 2023

(54) PROCESS FOR PREPARING A WELL FOR A HYDROCARBON RECOVERY OPERATION BY REDIRECTING PRODUCED EMULSION DURING STARTUP TO A LOW-PRESSURE SURFACE LINE

(71) Applicant: Cenovus Energy Inc., Calgary (CA)

(72) Inventor: Desmond Larry Procinsky, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

(21) Appl. No.: 17/574,425

(22) Filed: Jan. 12, 2022

(65) Prior Publication Data

US 2022/0228467 A1 Jul. 21, 2022

Related U.S. Application Data

(60) Provisional application No. 63/138,158, filed on Jan. 15, 2021.

(51) Int. Cl.
*E21B 43/24* (2006.01)
*E21B 43/34* (2006.01)

(52) U.S. Cl.
CPC ..... *E21B 43/24* (2013.01); *E21B 43/34* (2013.01)

(58) Field of Classification Search
CPC ..... E21B 43/24
See application file for complete search history.

(56) References Cited

U.S. PATENT DOCUMENTS 4,344,485 A 8/1982 Butler
2005/0061514 A1* 3/2005 Hopper ..... E21B 33/035 166/267
2008/0289822 A1* 11/2008 Betzer Tsilevich ..... E21B 43/2406 166/57
2012/0085547 A1* 4/2012 Arizmendi, Jr. ..... E21B 43/121 166/163
2012/0118565 A1* 5/2012 Trautman ..... E21B 43/24 166/272.6
2014/0332218 A1* 11/2014 Castrogiovanni ..... E21B 43/24 166/302

FOREIGN PATENT DOCUMENTS

CA 1304287 C 6/1992

* cited by examiner

*Primary Examiner* — Silvana C Runyan
(74) *Attorney, Agent, or Firm* — GORDON & JACOBSON, P.C.

(57) ABSTRACT

A process for preparing a well for use in subsequent recovery of hydrocarbons from a hydrocarbon-bearing formation wherein (i) mobilizing fluid is injected into the formation and emulsion fluids are produced to surface and directed to a high-pressure produced emulsion line, reducing pressure in the well, (ii) mobilizing fluid injection is terminated while emulsion production continues at reduced pressure, (iii) redirecting a portion of the reduced-pressure emulsion fluids to an additional low-pressure line instead of the produced emulsion line, and (iv) pumping the portion of the emulsion fluids at an elevated pressure from the additional line into the produced emulsion line.

8 Claims, 4 Drawing Sheets

PROCESS FOR PREPARING A WELL FOR A HYDROCARBON RECOVERY OPERATION BY REDIRECTING PRODUCED EMULSION DURING STARTUP TO A LOW-PRESSURE SURFACE LINE

TECHNICAL FIELD

The present disclosure relates to the preparation of a well for a hydrocarbon recovery operation.

BACKGROUND

Extensive deposits of viscous hydrocarbons exist around the world. Reservoirs of such deposits may be referred to as reservoirs of heavy hydrocarbon, heavy oil, extra-heavy oil, bitumen, or oil sands, and include large subterranean deposits in Alberta, Canada that are not susceptible to standard oil well production technologies. The hydrocarbons in such deposits are typically highly viscous and do not flow at commercially relevant rates at the temperatures and pressures present in the reservoir. For such reservoirs, various recovery techniques may be utilized to mobilize the hydrocarbons and produce the mobilized hydrocarbons from wells drilled in the reservoirs. For example, various thermal techniques may be used to heat the reservoir to mobilize the hydrocarbons and produce the heated, mobilized hydrocarbons from wells.

Hydrocarbon substances of high viscosity are generally categorized as "heavy oil" or as "bitumen". Although these terms are in common use, references to heavy oil and bitumen represent categories of convenience, and there is a continuum of properties between heavy oil and bitumen. Accordingly, references to such types of oil herein include the continuum of such substances, and do not imply the existence of some fixed and universally recognized boundary between the substances.

One thermal method of recovering viscous hydrocarbons from a subterranean hydrocarbon-bearing formation using spaced horizontal wells is known as steam-assisted gravity drainage (SAGD). Various embodiments of the SAGD process are described in Canadian Patent No. 1,304,287 and corresponding U.S. Pat. No. 4,344,485. In the SAGD process, steam is injected through an upper, horizontal, injection well into a viscous hydrocarbon reservoir while hydrocarbons are produced from a lower, substantially parallel, horizontal, production well that is vertically spaced from and near the injection well. The injection and production wells are generally located close to the base of the hydrocarbon deposit to collect the hydrocarbons that flow toward the production well.

During a start-up phase of operation in SAGD, steam is generally injected through tubing strings extending through an injection well and a production well. Fluids are produced from both wells via the annulus of each well, around the respective tubing string. The steam is thus circulated to heat the viscous hydrocarbons, promoting flow of the hydrocarbons to develop fluid communication between the injection well and the production well. After sufficient heating of the hydrocarbons around the injection well and the production well, the start-up phase is discontinued. A workover is performed to reconfigure the wells for the production phase of the operation, in particular, for injection of steam via the injection well and production of fluids via the production well.

After start-up, the steam injection is discontinued and, fluids that are produced are at high temperature and are sent to a cooling tank to facilitate handling of the fluid to separate liquid from gas, testing of the fluids, and subsequent handling. Flaring and venting of gases is normally carried out to burn off or release gases produced. Fluids are sent from the cooling tank to an open top tank followed by hauling away by trucking or pumping of recovered fluid. The handling of the produced fluids and gases poses a safety risk as well as environmental risk.

Improvements in transitioning from the start-up phase to the production phase of a hydrocarbon recovery operation are desirable.

SUMMARY

According to an aspect of an embodiment, there is provided a process for preparing a well for use in recovery of hydrocarbons from a hydrocarbon-bearing formation. The process includes injecting mobilizing fluid through the well and into the hydrocarbon-bearing formation, producing fluids from the hydrocarbon-bearing formation to a surface and directing the fluids into a produced emulsion line coupled to a facility for separation, discontinuing mobilizing fluid injection into the well for preparing the well for well kill, discontinuing directing produced fluids to the produced emulsion line and directing further produced fluids to an additional line as pressure in the well decreases, and pumping the further produced fluids from the additional line into the produced emulsion line for separation at the facility.

According to another aspect of an embodiment, there is provided a process for workover of a well utilized in recovery of hydrocarbons from a subterranean hydrocarbon formation. The process includes injecting steam into the well, directing produced fluids into a produced emulsion line for separation at a facility, discontinuing steam injection into the well, discontinuing directing produced fluids to the produced emulsion line and directing further produced fluids to an additional line as pressure in the well decreases, pumping the further produced fluids from the additional line into the produced emulsion line for separation, and injecting a well kill fluid and beginning the workover of the well after the pressure in the well decreases.

According to yet another aspect of an embodiment, there is provided a process for reducing pressure in a well for well kill after injecting mobilizing fluid. The process includes discontinuing mobilizing fluid injection and directing produced fluids to an additional line as pressure in the well decreases to bleed off the well, and pumping the produced fluids from the additional line into the produced emulsion line coupled to a facility for separation of the produced fluids.

BRIEF DESCRIPTION OF THE DRAWINGS

Embodiments of the present invention will be described, by way of example, with reference to the drawings and to the following description, in which.

DETAILED DESCRIPTION

Figure 1:
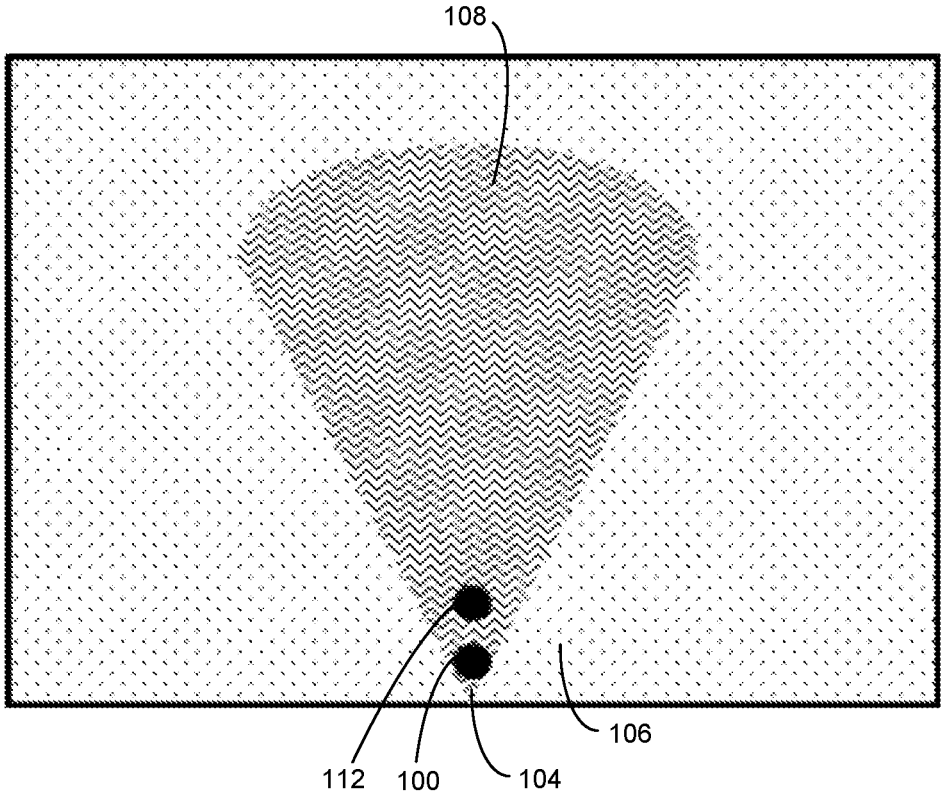
FIG. 1 is a schematic sectional view of a reservoir and shows the relative location of an injection well and a production well.

The disclosure generally relates to a process for preparing a well for use in recovery of hydrocarbons from a hydrocarbon-bearing formation. The process includes injecting mobilizing fluid through the well and into the hydrocarbon-bearing formation, producing fluids from the hydrocarbon-bearing formation to a surface and directing the fluids into a produced emulsion line coupled to a facility for separation, discontinuing mobilizing fluid injection into the well for preparing the well for well kill, discontinuing directing produced fluids to the produced emulsion line and directing further produced fluids to an additional line as pressure in the well decreases, and pumping the further produced fluids from the additional line into the produced emulsion line for separation at the facility.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Reference is made herein to an injection well and a production well. The injection well and the production well may be physically separate wells. Alternatively, the production well and the injection well may be housed, at least partially, in a single physical wellbore, for example, a multilateral well. The production well and the injection well may be functionally independent components that are hydraulically isolated from each other, and housed within a single physical wellbore.

Figure 2:
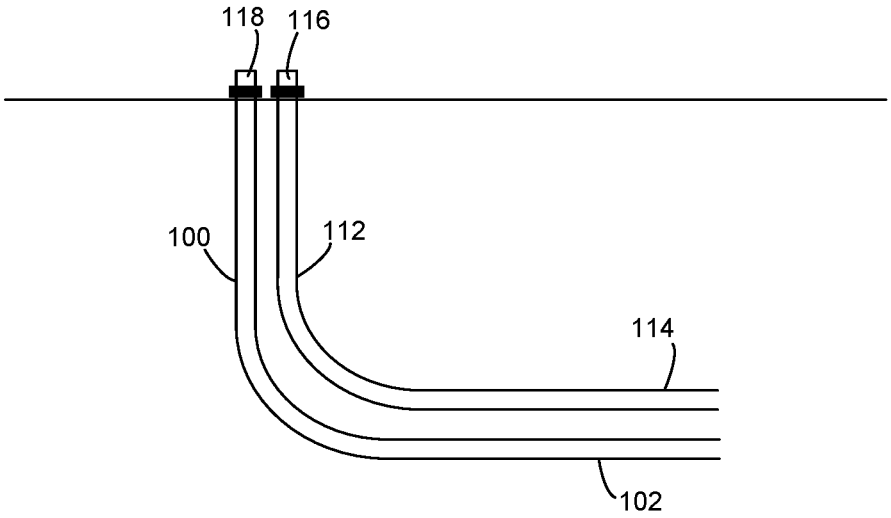
FIG. 2 is a sectional side view of a well pair including an injection well and a production well.

The description below refers generally to SAGD and to the injection of steam into a reservoir. The process described herein is not limited to SAGD, however, as the process may be utilized in other thermal operations such as a solvent assisted process (SAP) or other process. As described above, a steam-assisted gravity drainage (SAGD) process may be utilized for mobilizing viscous hydrocarbons. In the SAGD process, a well pair, including a hydrocarbon production well and a steam injection well are utilized. An example of a well pair is illustrated in FIG. 1 and FIG. 2. The hydrocarbon production well 100 includes a generally horizontal portion 102 that extends near the base or bottom 104 of the hydrocarbon reservoir 106. An injection well 112 also includes a generally horizontal portion 114 that is disposed generally parallel to and is spaced vertically above the horizontal portion 102 of the hydrocarbon production well 100.

During a production phase of SAGD, steam is injected through the injection well head 116 and through the steam injection well 112 to mobilize the hydrocarbons and create a steam chamber 108 in the reservoir 106, around and above the generally horizontal portion 114.

Viscous hydrocarbons in the reservoir 106 are heated and mobilized and the mobilized hydrocarbons drain under the effects of gravity. Fluids, including the mobilized hydrocarbons along with condensate, are collected in the generally horizontal portion 102 of the hydrocarbon production well 100 and are recovered via the hydrocarbon production well 100. Production may be carried out for any suitable period of time.

The steam that is injected via the injection well 112 may be generated at least partially from the produced water, for example, recovered from the production well 100. The produced water is de-oiled and softened to provide at least a portion of feed water to the steam generation facilities. The feed water may include water produced from the hydrocarbon recovery process or, for example, another hydrocarbon recovery process occurring in another reservoir, fresh water, water not previously utilized in the hydrocarbon recovery process, or a combination thereof.

Prior to the production phase, during a start-up phase of operation in SAGD, steam is generally injected through tubing strings that extend through the injection well 112 and through the production well 100, respectively. Fluids are produced from both wells via the annulus of each well, around the respective tubing string. The fluids that are produced are primarily steam, although some small amount of hydrocarbons may be present. The steam is thus circulated to heat the viscous hydrocarbons, promoting flow of the hydrocarbons to develop fluid communication between the injection well 112 and the production well 100.

After sufficient heating of the hydrocarbons around the injection well 112 and the production well 100, the start-up phase is discontinued. A workover is performed to reconfigure the wells for the production phase of the operation, in particular, for injection of steam via the injection well and production of fluids via the production well. The workover is performed to change, add, or remove equipment, such as piping, tubing, pumps, or other equipment in the injection well 112 or in the production well 100. In instances in which a well workover is performed, for example, the injection well head 116 or the production well head 118 is opened for such a workover.

After the start-up phase and before the production phase, the tubing string extending through the production well 100, for example, is removed and an electric submersible pump (ESP) is utilized for production. The ESP is connected to a production conduit that extends within the well casing of the production well 100 and the ESP and production conduit are deployed downhole, through the production well head 118 and the production well 100 until the ESP is at or near the horizontal portion 102 of the production well 100. Thus, the production well head 116 is opened for workover of the well and deployment of the ESP or other equipment downhole.

The pressure in the reservoir 106 and into the production well 100, however, may be in the range of, for example, about 2500 kPa to about 3200 kPa. In addition, to steam, hydrogen sulfide as well as vapours from lighter hydrocarbons may enter the well, exiting at the wellhead and posing a danger while work is performed on the well. These vapours pose a risk to workers near the production well head 118 when the well head is open. With an increase in the use of solvents in hydrocarbon recovery processes across the industry, these vapours are more likely to enter the wellbore, escape to the atmosphere, and cause risk to workers. Furthermore, typical well servicing post steam circulation to transition a well from start up to production requires a diverse number of personnel to provide services and equipment, such as testers to separate liquid from gas, chillers to cool the emulsion such that testers can process the emulsion and fluid management personnel and equipment to store, truck and/or pump away recovered fluids. The current process is costly, time consuming and complex and has known safety and environmental risks. The present disclosure describes an improved process to mitigate risks concurrent with reducing costs and reducing well downtime.

Figure 3:
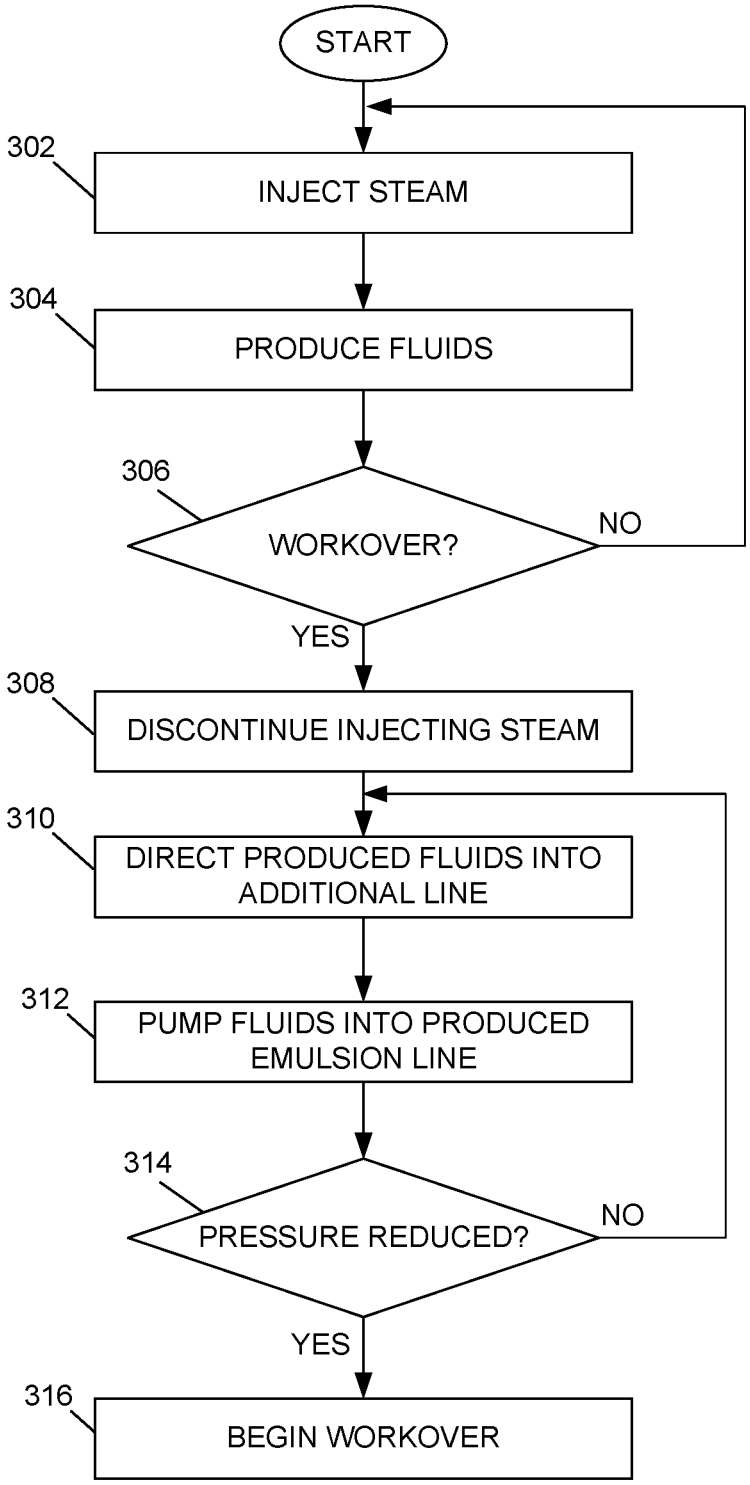
FIG. 3 is a flowchart showing a process of preparing a well for a hydrocarbon recovery operation according to an embodiment.

Reference is made to FIG. 3, to describe a process of preparing a well for a hydrocarbon recovery operation according to an embodiment. The process may contain additional or fewer subprocesses than shown or described, and parts of the process may be performed in a different order.

As referred to above, mobilizing fluid is injected into the reservoir 106 at 302 to mobilize the hydrocarbons and create a steam chamber 108 in the reservoir 106 and fluids are produced at 304. The mobilizing fluid includes steam and may, optionally, include a solvent or solvents or other additives.

The injection of mobilizing fluid including steam at 302 may be carried out during the start-up phase of operation in which steam is injected through a tubing string of the injection well 112 and fluids are produced at 304 via the annulus of the same injection well 112. In addition, steam is injected through a tubing string of the production well 100 and fluids are produced via the annulus of the same production well 100.

Alternatively, the injection of mobilizing fluid at 302 may include steam injection during the production phase of the hydrocarbon recovery process in which steam is injected into the reservoir via the injection well and fluids are produced at 304 via the production well 100.

When no workover is performed, the process continues at 302.

In response to a decision to perform a workover at 306, the process continues at 308. The decision to perform a workover at 306 may be made to change, add, or remove equipment in either the injection well 112 or in the production well 100. For example, the decision to perform a workover at 306 may be made after circulating steam in a start-up phase for a period of time sufficient to heat the hydrocarbons in the reservoir, around the injection well 112 and the production well 100, and develop fluid communication between the injection well 112 and the production well 100 prior to transitioning to a production phase.

The injection of mobilizing fluid including steam is discontinued at 308. A connection from a steam line to the well is shut off. In the case of a connection from the steam line to the production well 100, the connection may be permanently shut or removed.

A fluid line connecting the well to an additional pipeline is established and further fluids that are produced from the well are directed to the additional line. The additional line may be a test line that is generally utilized for testing the emulsion produced. The test line is an additional line, in addition to the produced emulsion line that is coupled to a pipeline to direct produced emulsions to the plant for separation. During a production phase, a test line may be utilized as produced fluids from a production well 100 are directed to a produced emulsion line and part of the produced fluids may be split off into the test line for testing. The part of the produced fluids that are split off from the test line are tested on pad and directed back into the produced emulsion line before the produced fluids in the produced emulsion line reaches the pipeline. The injection well 112 may also be fluidly coupled to the additional line, such as the test line, to direct further produced fluids from the injection well 112, after the start-up phase of the operation, into the additional line to decrease the pressure in the injection well 112.

After the injection of mobilizing fluid is discontinued at 308, the produced fluids are directed to the test line at 310 rather than to the produced emulsion line as the pressure decreases in the well during a bleed-off process. Pressures in the test line are lower than that in the produced emulsion line as other wells are connected to and direct produced fluids into the produced emulsion line, maintaining pressure in the produced emulsion line. Thus, even as the pressure decreases in the well, produced fluids still flow into the test line.

A pump is utilized to pump fluids from the additional line, such as the test line, into the produced emulsion line at 312. The pump may be a high pressure pump, such as a progressive cavity pump. In one example, the pump is an IJACK XFER™ 1245 reciprocating pump with high temperature modifications to facilitate use at about 150° C. The pump that is utilized may be suitable for sour service with exposure to hydrogen sulfide, suitable for pumping fluids and gases in a multi-phase flow, and suitable for use at temperatures of from about 50° C. to about 200° C. The pump may also be suitable for variable flow rates of from zero to greater than 240 $m^3$/day while maintaining discharge pressure greater than about 3000 kPa, and may be equipped with an Emergency Shut Down Device.

Fluid production from the well continues as the pressure in the well decreases. The pump provides suction on the intake side connected to the test line, drawing the pressure down to, for example, about 300 kPa or less in the well. The pump directs the produced fluids from the test line, into the produced emulsion line at an increased pressure sufficient to force the produced fluids into the produced emulsion line. Thus, the pump utilized is a high pressure pump suitable for pumping to pressure in the range of about 2500 kPa to about 3200 kPa.

In response to determining that the pressure in the well is reduced to a suitable pressure at 314, the process continues at 316. The pressure may be a threshold pressure of, for example, 300 kPa. Thus, when the pressure is decreased from an initial pressure to 300 kPa or less, the process continues at 316.

The fluid connection of the injection well to the additional line is shut and may be removed. The fluid connection of the production well to the additional line is also shut. A well kill fluid may be added and the well head is opened at 316 for the purpose of performing the workover.

After completion of the workover, the steam line connection to the injection well is opened and produced fluids from the production well are directed into the produced emulsion line in, for example, a SAGD operation.

Figure 4:
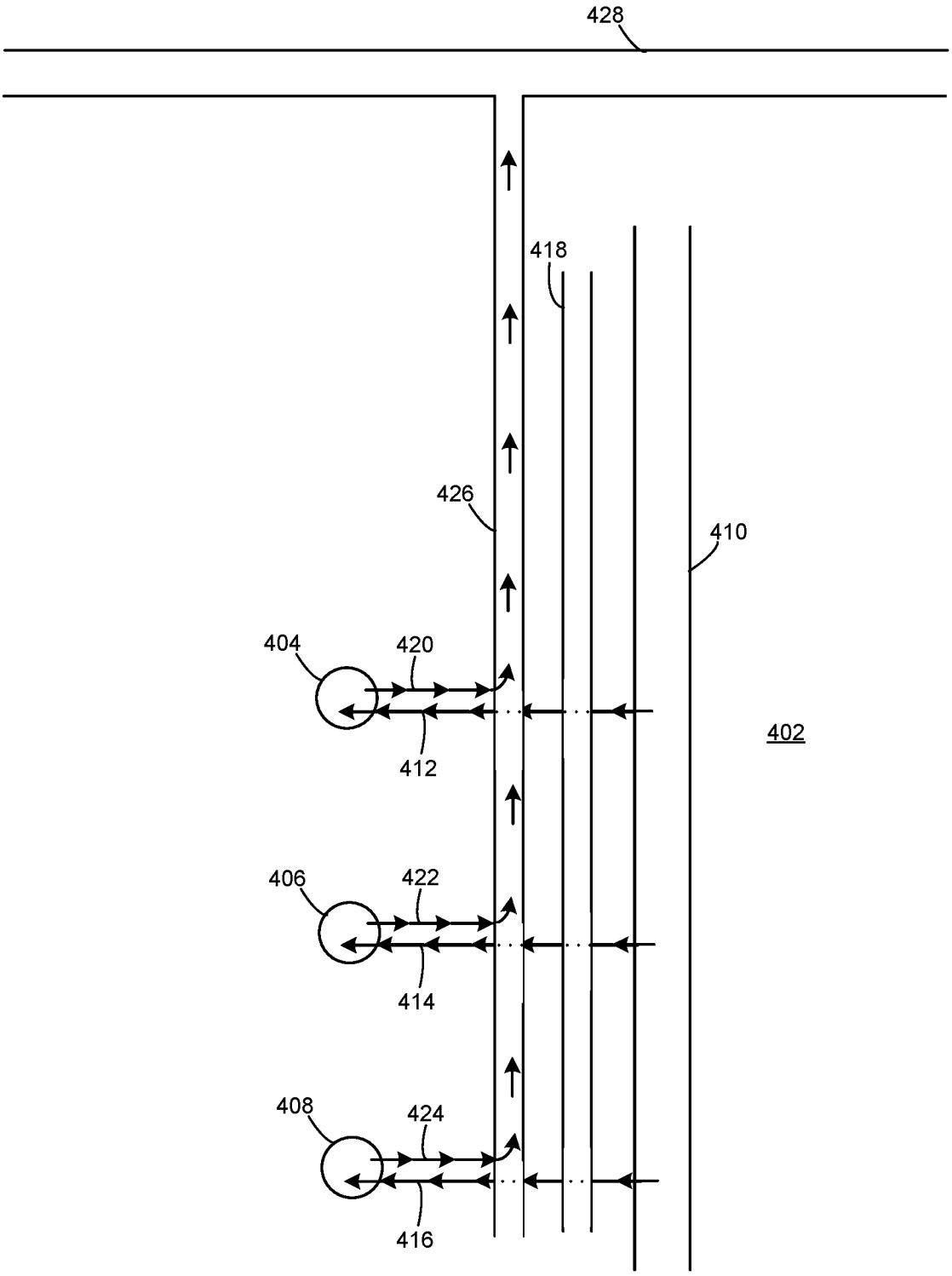
FIG. 4 is a simplified schematic illustrating a part of the process of preparing for hydrocarbon recovery.
Figure 5:
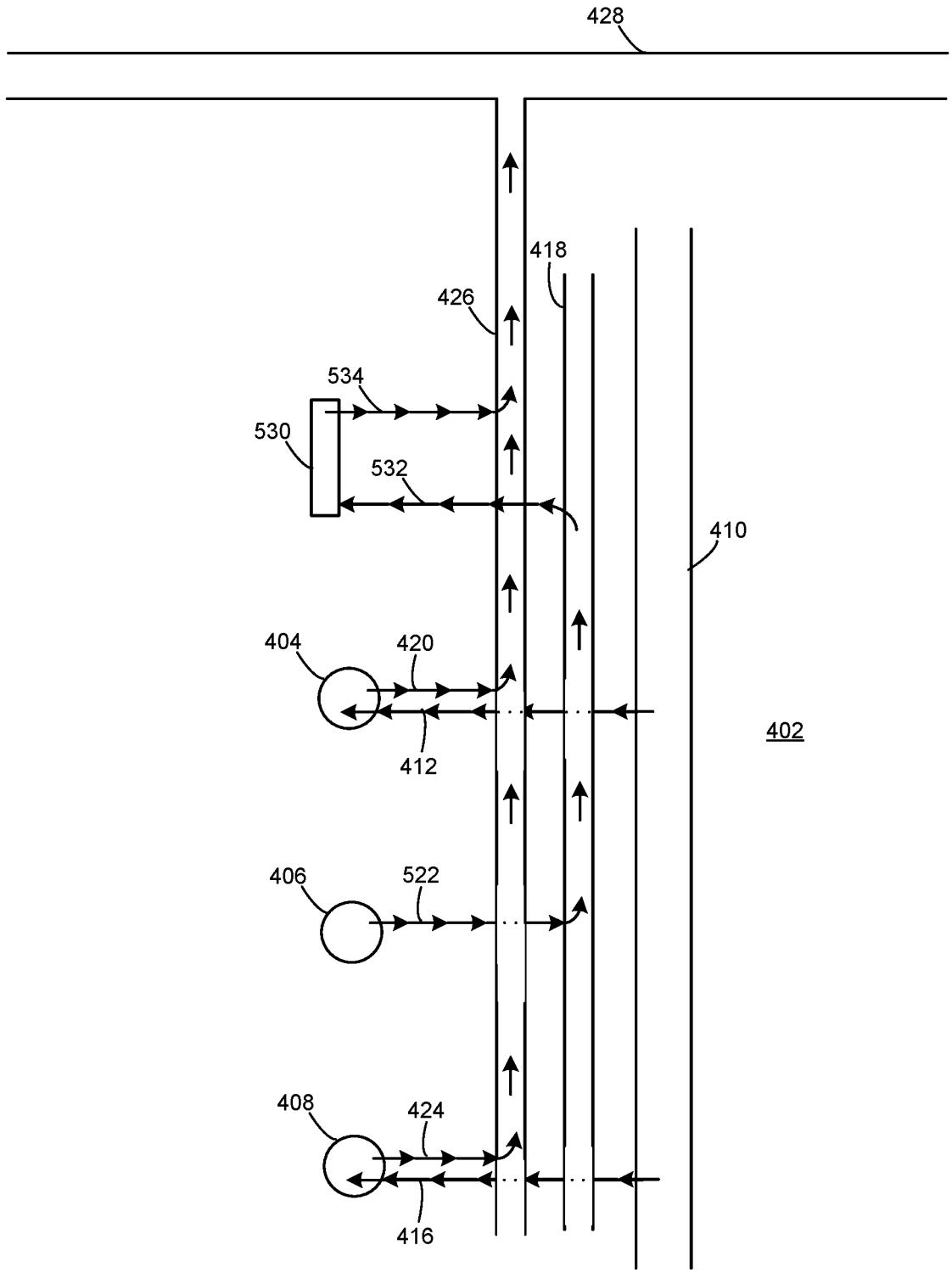
FIG. 5 is a simplified schematic illustrating another part of the process of preparing for hydrocarbon recovery in accordance with an embodiment.

Simplified schematic views illustrating a system in parts of the process of FIG. 3 are shown in FIG. 4 and FIG. 5. For the purpose of this explanation, a well pad 402 or portion of a well pad is illustrated and includes three pairs of wells. Each well pair 404, 406, 408 includes an injection well 112 and a production well 118. A steam line 410 is connected to a steam source and provides steam to the well pad 402.

Each well pair 404, 406, 408 is fluidly coupled to the steam line 410 by a respective steam pipe 412, 414, 416, to provide steam from the steam line 410 to each well pair 404, 406, 408 and into the reservoir via the wells of the well pairs 404, 406, 408.

Each well pair 404, 406, 408 is also fluidly connected to a produced emulsion line 426 by respective produced fluid lines 420, 422, 424, which are fluidly connected to an emulsion pipeline 428 that carries produced fluids to a facility for separation.

In addition to the emulsion line 426, an additional line, which in this example is a test line 418, is utilized for testing the emulsion produced during the production phase of the operation. The test line 418 directs produced fluids to a plant for testing.

During the start-up phase, steam from the steam line 410 is injected into the reservoir 106 at 302. The steam is injected at 302 via the steam lines 410, 412, 414 fluidly coupled to the injection well and the production well of each of the well pairs 404, 406, 408. The steam is injected for a period of time sufficient to heat the hydrocarbons in the reservoir, around the injection well 112 and the production well 100, and develop fluid communication between the injection well 112 and the production well 100.

Fluids, primarily comprising steam, are produced from the injection well and production well of each of the well pairs 404, 406, 408 at 304 during start-up, and are directed to the produced emulsion line 426 via the produced fluid lines 420, 422, 424.

Thus, steam is injected at 302 and fluids produced at 304 to heat the hydrocarbons in the reservoir, around the injection well 112 and the production well 100, and to develop fluid communication between the injection well 112 and the production well 100. After heating for a period of time in the start-up phase of the operation for a well pair, the decision is made at 306 to proceed to the production phase of the operation and the process continues at 308. In the present example, the start-up phase of the operation is discontinued for the well pair 406. The well pair 404 and the well pair 408 continue injecting steam and producing fluids in the start-up phase.

Steam injection utilizing the well pair 406 is discontinued at 308. In the schematic shown in FIG. 5, steam from the steam line 410 to the well pair 406 is discontinued. The steam line 414 to the injection well of the well pair 406 may be maintained, though the steam flow is discontinued. The steam line 414 may be maintained to utilize the steam line during the production phase to direct steam from the steam line 410 to the injection well. The steam line to the production well, however, may be permanently shut or removed.

The produced fluid from the well pair 406 is not directed to the produced emulsion line 426. Instead, the produced fluid from the well pair 406 is directed to the test line 418 as the pressure in the well pair 406 decreases during a bleed-off process in preparation for well kill. Thus, the produced fluid from the well pair 406 is not directed along the produced fluid line 422 to the produced emulsion line and is instead directed along an alternate line 522 to the test line 418 at 310. Directing the produced fluid to the test line 418 facilitates the bleed-off of fluids to lower pressures in the well pair 404. As the pressure in the well pair 404 decreases, insufficient pressure is present to force the flow of the produced fluids into the produced emulsion line 426. The test line 418, however, receives the produced fluids.

A high pressure pump 530 suitable to operate within existing system pressure is fluidly coupled to the test line 418 by a fluid intake line 532 and the outlet of the high pressure pump 530 is fluidly coupled by an outlet line 534 to the produced emulsion line 426. The high pressure pump 530 draws the further produced fluids from the well pair 406, into the test line 418 and pumps the further produced fluids at higher pressure into the produced emulsion line at 312.

Fluid production from the well pair 406 continues as the pressure in the well pair 406 decreases. The high pressure pump 530 provides suction on the intake side connected to the test line 418, drawing the pressure down to, for example, about 300 kPa or less in the well. The pump directs the produced fluids from the test line, into the produced emulsion line at an increased pressure in the range of about 2500 kPa to about 3200 kPa.

In response to determining that the pressure in the well is reduced to a threshold pressure or less at 314, the process continues at 316. A well kill fluid may be added to the wells and the workover begins.

In the above-described embodiment, the additional line is a test line that is generally utilized for testing the emulsion produced. Rather that utilizing a test line, the fluid from the well may be directed to a line other than the test line, and then to a pump that is coupled to the a produced emulsion line to direct produced emulsions to the plant for separation. Thus, any line may be utilized such that the produced emulsion is directed to the pump and pumped into the produced emulsion line at a higher pressure than the pressure at which the produced emulsion is received from the well.

Advantageously, produced fluids may be directed into a test line or an additional line at lower pressure and pumped into the produced emulsion line at higher pressure. The produced fluids are thus directed to the facility for separation and recycling of water present. Thus, the use of a cooling tank and open top tank are not required during the bleed-off process. Further, produced fluids, which may include viscous hydrocarbons, are not trucked back to the facility, reducing the cost of the operation. Thus, costs are reduced and downtime of the well may be reduced. The use of the additional line or test line and the pump also reduces the exposure of workers at or near the well undergoing well kill as the fluids may be directed to the test line by opening and closing valves.

The described embodiments are to be considered in all respects only as illustrative and not restrictive. The scope of the claims should not be limited by the preferred embodiments set forth in the examples, but should be given the broadest interpretation consistent with the description as a whole. All changes that come with meaning and range of equivalency of the claims are to be embraced within their scope.

The invention claimed is:

1. A process for preparing a well for subsequent use in recovery of hydrocarbons from a hydrocarbon-bearing formation, the process comprising:

a. injecting a mobilizing fluid through the well and into the hydrocarbon-bearing formation to mobilize a portion of the hydrocarbons in the hydrocarbon-bearing formation adjacent the well, the injecting of the mobilizing fluid increasing pressure in the well;

b. producing emulsion fluids comprising the portion of the hydrocarbons from the hydrocarbon-bearing formation through the well to surface to prepare the well for subsequent hydrocarbon recovery operations, thus decreasing the pressure in the well, and directing the emulsion fluids into a produced emulsion line at the surface operating at a first pressure and coupled to a facility for separation of the portion of the hydrocarbons from the emulsion fluids;

c. discontinuing the injecting of the mobilizing fluid into the well while continuing the producing of the emulsion fluids at a reduced pressure to the surface;

d. redirecting at least a portion of the emulsion fluids at the reduced pressure to an additional line at the surface instead of to the produced emulsion line, the additional line operating at a second pressure lower than the first pressure; and e. pumping the at least a portion of the emulsion fluids from the additional line at a third pressure higher than the second pressure into the produced emulsion line for separation of the hydrocarbons in the at least a portion of the emulsion fluids at the facility.

2. The process according to claim 1, comprising the step after step e. of conducting a workover on the well after the pressure in the well decreases to a threshold pressure, wherein the workover comprises preparing the well for the subsequent hydrocarbon recovery operations.

3. The process according to claim 2, wherein the workover is conducted after a well kill operation after step e., the well kill operation comprising injecting a fluid into the well to prevent flow of the emulsion fluids through the well to the surface.

4. The process according to claim 2, wherein the threshold pressure is about 300 kPa or less.

5. The process according to claim 1, wherein the pumping of the at least a portion of the emulsion fluids comprises pumping utilizing a pump configured to direct the at least a portion of the emulsion fluids into the produced emulsion line while increasing the at least a portion of the emulsion fluids to the third pressure.

6. The process according to claim 1, wherein the additional line comprises a test line configured for testing properties of the emulsion fluids.

7. The process according to claim 1, wherein the third pressure is in a range of about 2500 kPa to about 3200 kPa.

8. The process according to claim 1, wherein the produced emulsion line is coupled to a plurality of additional wells for receiving produced fluids from the plurality of additional wells.

* * * * *